US005238456A

United States Patent [19]

Chang

[11] Patent Number: 5,238,456

[45] Date of Patent: Aug. 24, 1993

[54] REINFORCED SWING SEAT

[76] Inventor: Tony Chang, c/o Hung Hsing Patent Service Center, P.O. Box 55-1670, Taipei (10477), Taiwan

[21] Appl. No.: 886,156

[22] Filed: May 21, 1992

[51] Int. Cl.[5] ..... A63G 9/00

[52] U.S. Cl. ..... 472/118; 297/273; 297/DIG. 2

[58] Field of Search ..... 472/118-125; 297/273, DIG. 2

[56] References Cited

U.S. PATENT DOCUMENTS

| | | | |
|---|---|---|---|
| 3,897,056 | 7/1975 | Hock et al. | 472/118 |
| 4,066,258 | 1/1978 | Yates | 472/118 |
| 4,524,966 | 6/1985 | Shannon et al. | 472/118 |
| 4,575,073 | 3/1986 | Thacker | 472/118 |
| 4,706,952 | 11/1987 | Shannon et al. | 472/118 |
| 4,793,607 | 12/1988 | Suellentrop | 472/118 |

*Primary Examiner*—Richard E. Chilcot, Jr.

[57] ABSTRACT

A reinforced swing seat includes a swing seat having a pair of reinforcing members embedded in two opposite end portions of the swing seat, each reinforcing member made of reinforced engineering plastic material and integrally molded and combined with an intermediate strap portion disposed between the two opposite end portions of the seat and each reinforcing member having a plurality of stabilizing stems respectively protruding upwardly and downwardly from the reinforcing member to increase its cross linking and binding with the swing seat also made of plastic material but with lower cost when integrally molded together, thereby providing a swing seat having proper tensile strength and reasonable cost.

3 Claims, 2 Drawing Sheets

REINFORCED SWING SEAT

BACKGROUND OF THE INVENTION

A conventional swing seat suspended to a swing stand may be made of wooden or plastic materials. The seat is being made of wooden material will be corroded by environmental moisture or pollutants to be damaged especially for a lawn swing. If the seat is made of plastic material, the seat is preferably made of reinforced engineering plastic material which however is expensive than a common plastic material. For instance, the seat may even be made of plastic material with cheaper cost but less strength, which may be easily broken especially when served for an amusement swing such as taught by S. W. Zippler in his U.S. Pat. No. 2,146,045. The swinging operations of the Zippler's seat (15) in a variety of directions may easily break the swing seat such as at the joint between each end portion of the seat adjacent to each opening (14') and the suspending bar 12 secured with the seat, thereby possibly causing injury to a swing player sitting on the seat (15).

SUMMARY OF THE INVENTION

The object of the present invention is to provide a reinforced swing seat including a swing seat having a pair of reinforcing members embedded in two opposite end portions of the swing seat, each reinforcing member made of reinforced engineering plastic material and integrally molded and combined with an intermediate strap portion disposed between the two opposite end portions of the seat and each reinforcing member having a plurality of stabilizing stems respectively protruding upwardly and downwardly from the reinforcing member to increase its "cross linking" and binding with the swing seat also made of plastic material but with lower cost when integrally molded together, thereby providing a swing seat having proper tensile strength and reasonable cost for safety purpose.

DETAILED DESCRIPTION

Figure 1:
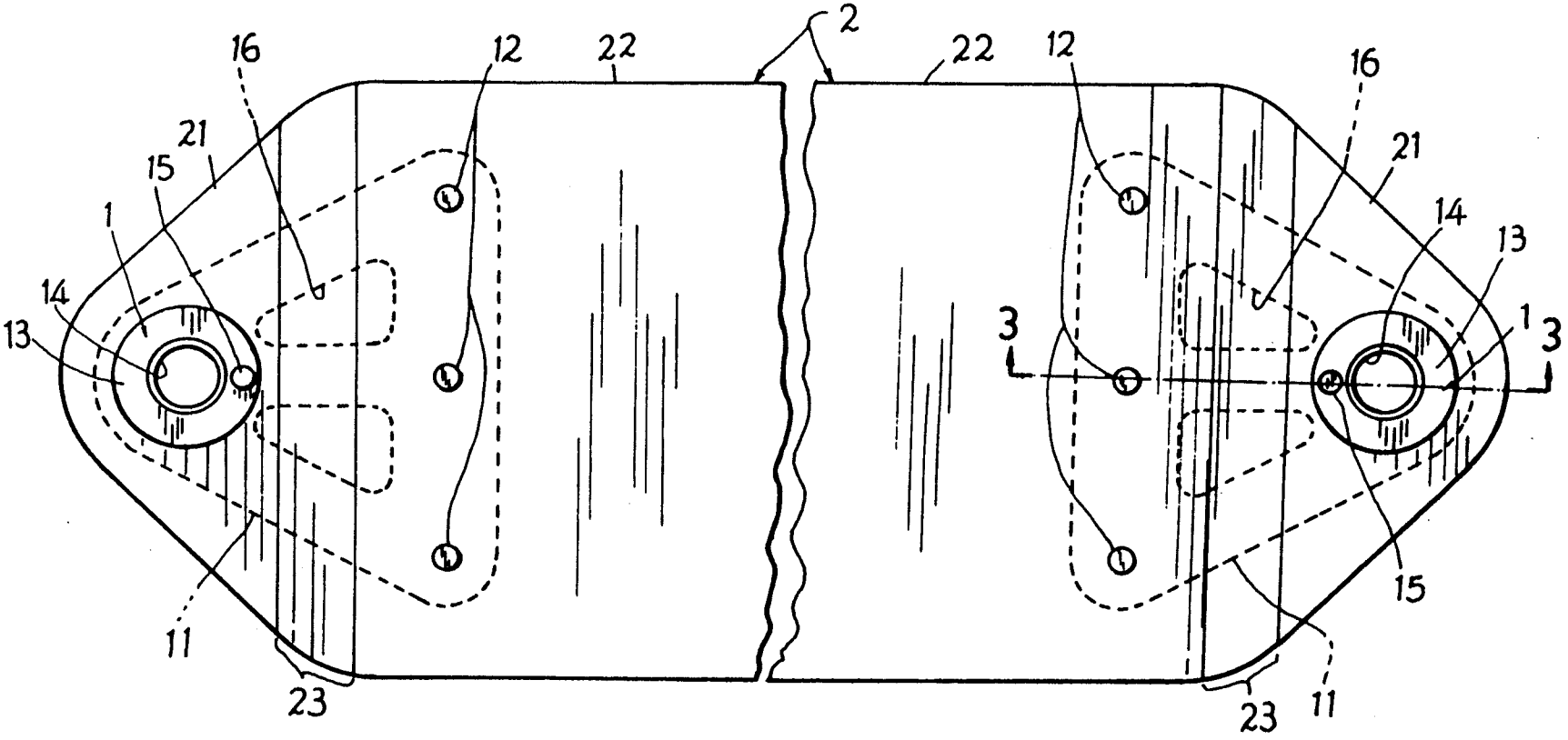
FIG. 1 is a top view illustration of the present invention.
Figure 2:
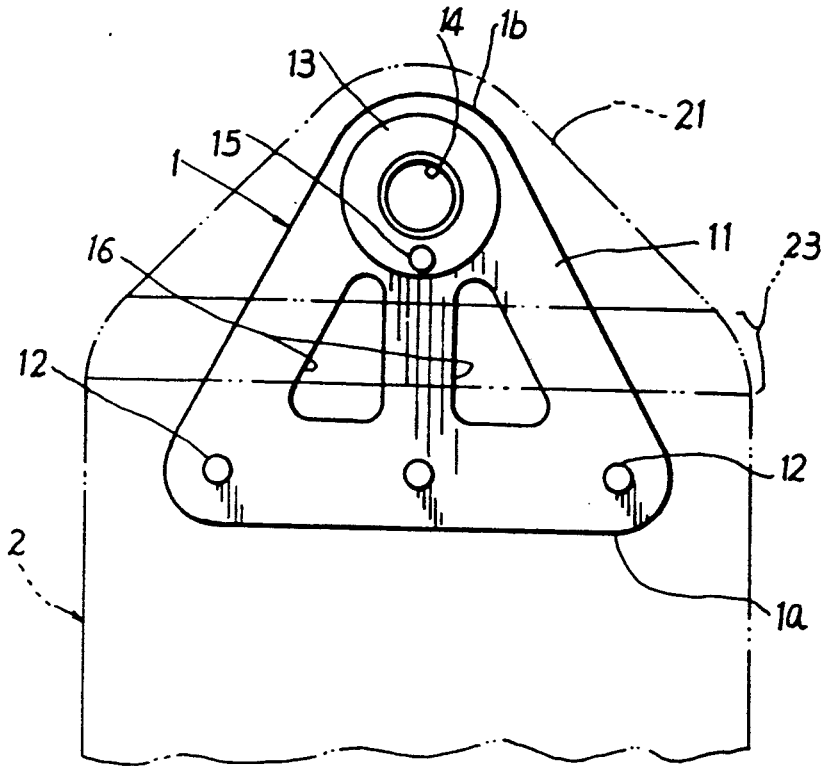
FIG. 2 is a sectional drawing of the present invention.

As shown in the drawing figures, the present invention comprises: at least a pair of reinforcing members 1 embedded in and integrally formed on two opposite end portions of a swing seat 2 which is hanged or suspended under a bracket or stand of a swing for swinging playing purpose.

The swing seat 2 may be made of plastic material of average commercial grade, medium or low cost, such as ethylene-vinyl acetate (EVA), etc.

Each reinforcing member 1 may be made of reinforced engineering plastic material having better tensile strength, corrosion resistance and other physical and chemical properties, even having a coat higher than that of the plastic material forming the swing seat 2. However, each reinforcing member 1 is just disposed on each end portion of the seat 2 and will greatly reduce the production cost of the seat as compared with a seat if being fully made of high-cost engineering material.

Figure 3:
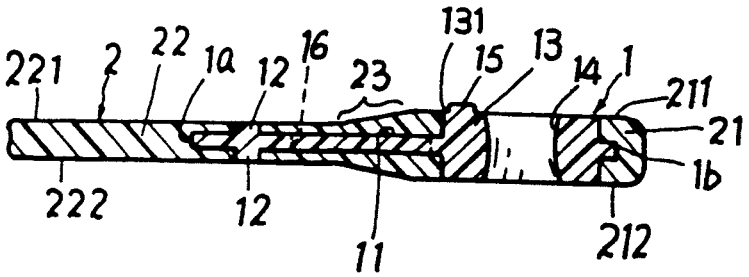
FIG. 3 is an illustration showing a swing seat of the present invention.

The swing seat 2 includes: an elongate intermediate strap portion 22 having two end portions 21 disposed on two opposite ends of the intermediate strap portion 22, each end portion 21 having a thickness defined between an upper and a lower end surfaces 211, 212 thicker than a thickness deinfed between an upper and a lower surfaces 221, 222 of the elongate strap portion 22 (FIG. 3). Each end portion 21 is integrally connected with the elongate strap portion 22 by a tapered portion 23 positioned between the end portion 21 and the intermediate strap portion 22.

Each reinforcing member 1 includes: a substrate plate 11 generally triangular shaped or formed with other shapes, a plurality of inner stabilizing stems 12 respectively protruding upwardly and downwardly from the substrate plate 11 adjacent to an inner edge portion 1*a* of the reinforcing member 1, a collar portion 13 secured with the substrate plate 11 and having a thickness thicker than that of the plate 11, and having a through hole 14 formed in the collar portion 13 adjacent to an outer edge portion 1*b* of the reinforcing member 1, at least an outer stabilizing stem 15 protruding upwardly from the collar portion 13 which is adapted to be secured into a cavity of a mold for a molding processing with the swing seat 2 of the present invention, and is severed after finishing the processing to allow an upper surface 131 of the collar portion 13 to be coplanar to an upper surface 211 of the end portion 21 of the swing seat 2, and a plurality of slots 16 formed in the substrate plate 11. Each inner stem 12 has an upper or lower tip portion coplanar to an upper surface 221 or lower surface 222 of the strap portion 22 of the swing seat 2.

During a molding processing for integrally combining the swing seat 2 with the two reinforcing members 1, that is, for embedding each reinforcing member 1 within each end portion 21 of the swing seat 2, each reinforcing member 1 after being prefabricated is put into a mold for molding process with the inner stabilizing stems 12 contacting the inner surfaces (not shown) of a mold and with the outer stabilizing stem 15 engageably inserted into a mold cavity (not shown) so as to firmly retain the prefabricated reinforcing member 1 within a processing mold without being loosened, vibrated or rotated during molding process.

Then the resin material for making the swing seat 2 is injected into the mold to be integrally combined with each reinforcing member 1 pre-set in the mold.

Due to a three-dimensional configuration of the reinforcing member 1 having the slots 16, the inner stabilizing stems 12 and the collar portion 13 higher than the plate 11, each end portion 21, tapered portion 23 and the intermediate strap portion 22 of the seat 2 will be "crosslinked" with the slots 16, the stems 12 the collar portion 13 and the plate 11 of each reinforcing member 1 to form a "well-bonded" plastic molding product of swing seat after being released from the mold.

The outer stabilizing stem 15 is then severed from the collar portion 13 of the reinforcing member 1 to have the upper surface 131 of the collar portion 13 coplanar to the upper surface 211 of the end portion 21 of the seat 2.

A rope can be inserted through the hole 14 of the collar portion 13 and tied therewith for suspending the seat 2 to a bracket of a swing stand or a building for swinging purpose.

Each reinforcing member 1 is embedded in each end portion 21 of the swing seat 2 to thereby increase tensile strength of the seat 2. Since the reinforcing members 1 only occupy a small volume of a swing seat, the remaining portion of the seat 2 (except the end portions 21 of the seat 2) can be made of plastic materials with average grade and lower cost for saving installation cost of a swing.

By a principle of "like-dissolves-like" in organic chemistry, the reinforcing members 1 made of engineering or reinforced plastic material (such as Nylon) will be compatible with the swing seat 2 also made of plastic materials.

Therefore, the present invention may reduce an installation cost of a swing especially for a lawn swing by integrally molding plastic materials, and may be resistant to weather moisture or environmental pollutants because of the plastic-made swing seat.

I claim:

1. A reinforced swing seat comprising:

a swing seat made of plastic material including: an elongate intermediate strap portion having two end portions disposed on two opposite ends of the intermediate strap portion, each end portion having a thickness defined between an upper and a lower end surfaces of the end portion thicker than a thickness defined between an upper and a lower surfaces of the elongate strap portion, each said end portion is integrally connected with the elongate strap portion by a tapered portion positioned between the end portion and the intermediate strap portion; and a pair of reinforcing members embedded in the two end portions of said swing seat, each said reinforcing member made of reinforced engineering plastic materials including: a substrate plate, a plurality of inner stabilizing stems respectively protruding upwardly and downwardly from the substrate plate adjacent to an inner edge portion of the reinforcing member approximating the strap portion of the swing seat, a collar portion secured with the substrate plate and having a thickness thicker than that of the substrate plate, and having a through hole formed in the collar portion adjacent to an outer edge portion of the reinforcing member, at least an outer stabilizing stem protruding upwardly from the collar portion adapted to be stably secured into a cavity of a mold for integrally molding said reinforcing member with the swing seat, and a plurality of slots formed in the substrate plate, whereby upon a molding processing for integrally combining the swing seat with the two reinforcing members, a three-dimensional configuration of each said reinforcing member having the slots, the inner stabilizing stems and the collar portion thicker than the substrate plate will be well bonded with each said end portion of said seat, each said tapered portion and the intermediate strap portion of the seat to form a reinforced swing seat having said reinforcing members integrally embedded in said two end portions of said seat.

2. A reinforced swing seat according to claim 1, wherein said outer stabilizing stem is severed from the collar portion of the reinforcing member to have an upper surface of the collar portion coplanar to the upper surface of the end portion of the seat.

3. A reinforced swing seat according to claim 1, wherein each said inner stabilizing stem has a tip portion coplanar to either an upper or a lower surface of said intermediate strap portion of said swing seat.

* * * * *